US005735952A

United States Patent [19]

Wilson, Sr.

[11] Patent Number: 5,735,952

[45] Date of Patent: Apr. 7, 1998

[54] PAVEMENT AND TENNIS COURT COATING MACHINE

[76] Inventor: Jack H. Wilson, Sr., 3775 Coker Rd., Jackson, Miss. 39213

[21] Appl. No.: 593,289

[22] Filed: Jan. 29, 1996

[51] Int. Cl.[6] ..... B05C 11/02; B05C 1/06; B05C 11/00; B05C 3/02

[52] U.S. Cl. ..... 118/100; 118/256; 118/264; 118/407; 15/501; 15/79.1; 15/98; 15/103.5; 15/401; 404/111

[58] Field of Search ..... 118/100, 256, 118/258, 264, 407; 15/50.1, 79.1, 98, 103.5, 401; 404/111

[56] References Cited

U.S. PATENT DOCUMENTS

| | | | |
|---|---|---|---|
| 2,317,843 | 4/1943 | Backlund | 15/50 |
| 2,531,370 | 11/1950 | Thompson | 15/50.1 |
| 2,989,769 | 6/1961 | Houser | 15/401 |
| 3,277,511 | 10/1966 | Little et al. | 15/50.1 |
| 3,305,887 | 2/1967 | Turner | 15/50 |
| 3,345,671 | 10/1967 | Wilson et al. | 15/320 |
| 3,571,841 | 3/1971 | Crouser | 15/401 |
| 3,841,779 | 10/1974 | Ray . | |
| 3,989,403 | 11/1976 | Verive . | |
| 4,191,590 | 3/1980 | Sundheim | 134/21 |
| 4,575,279 | 3/1986 | Mateja . | |
| 4,732,109 | 3/1988 | Selby | 118/713 |
| 4,789,265 | 12/1988 | Wilson et al. . | |
| 4,906,126 | 3/1990 | Wilson et al. . | |
| 4,917,533 | 4/1990 | Wilson . | |
| 4,959,884 | 10/1990 | Ingermann et al. | 15/302 |
| 5,054,159 | 10/1991 | Richardson | 15/400 |
| 5,239,720 | 8/1993 | Wood et al. | 15/4 |
| 5,287,583 | 2/1994 | Lija | 15/98 |
| 5,301,387 | 4/1994 | Thomas et al. | 15/322 |
| 5,362,170 | 11/1994 | Schantz | 404/101 |
| 5,366,309 | 11/1994 | Springall . | |

*Primary Examiner*—Donald E. Czaja
*Assistant Examiner*—Jacqueline A. Ruller
*Attorney, Agent, or Firm*—Merek & Voorhees

[57] ABSTRACT

A coating machine comprising a tank for holding a quantity of coating material, a conduit connected to the tank for conveying coating material from the tank and dispensing coating material onto a surface and a coating material spreading arrangement extending from the tank and the conduit for spreading coating material, the arrangement including a first blade, a brush, a middle blade, a pair of end blades forming a box with the first and middle blades and a finish blade of sufficient width to remove the tracks of the end blades.

10 Claims, 4 Drawing Sheets

FIG. 2
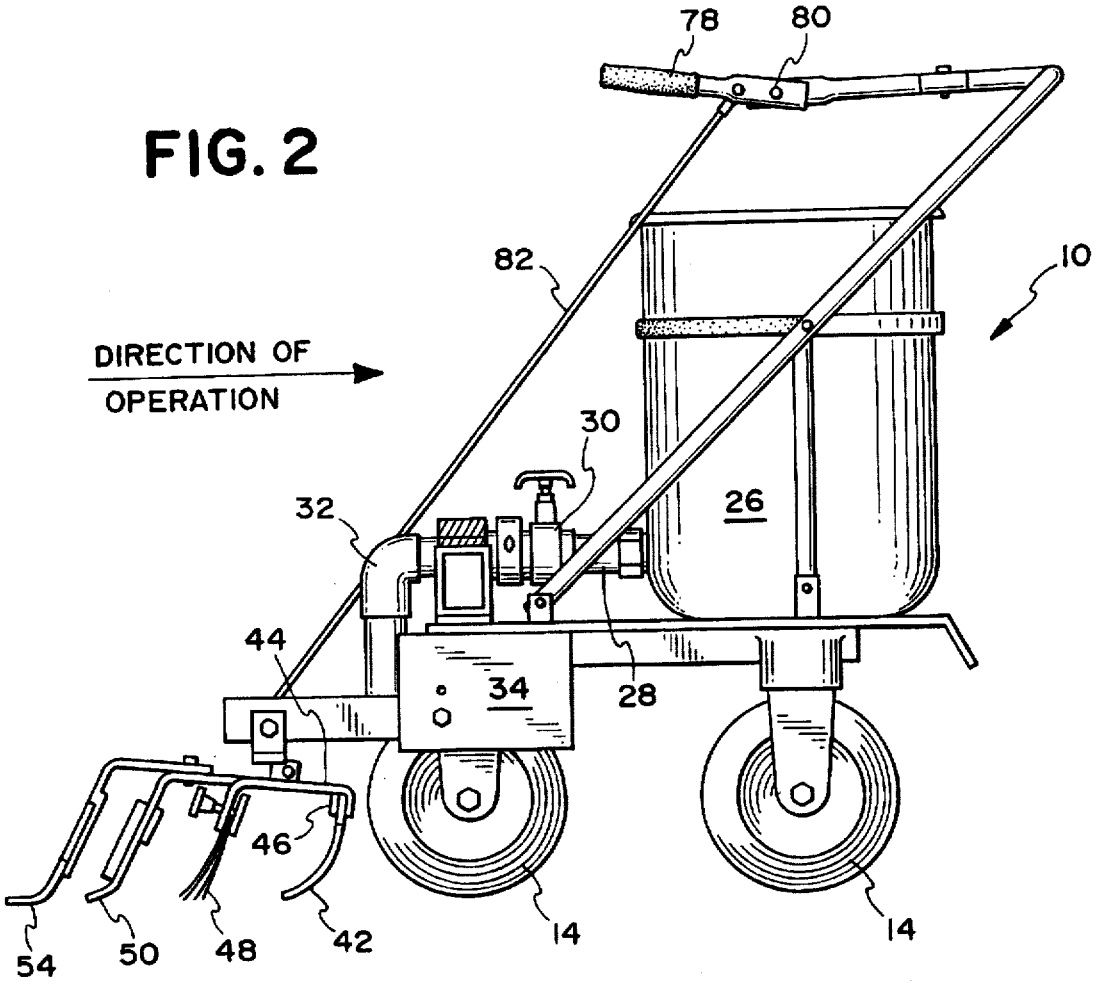
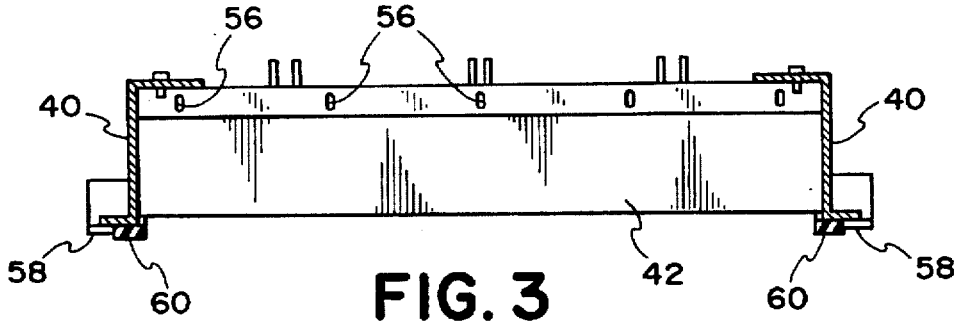
FIG. 3
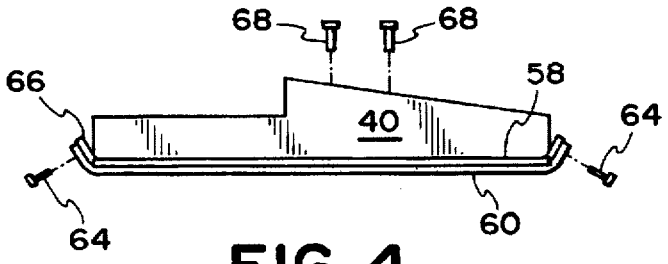
FIG. 4
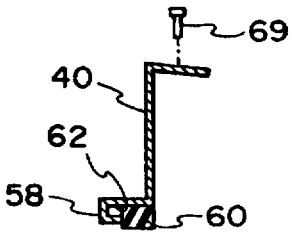
FIG. 5

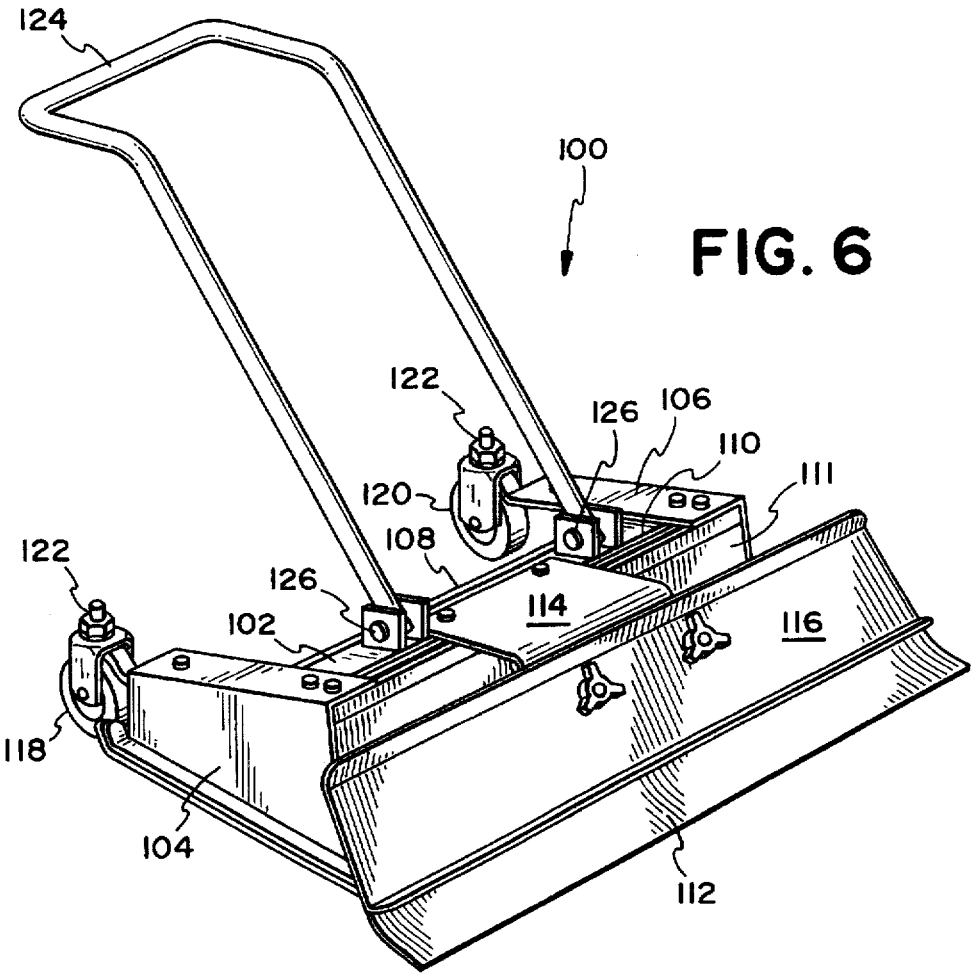
FIG. 6
FIG. 7
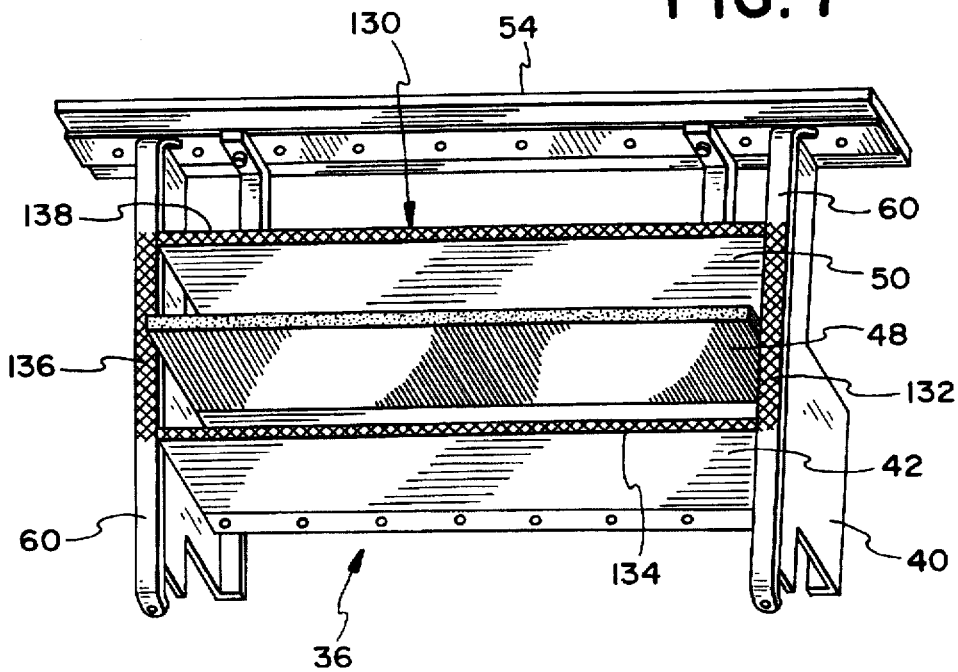

PAVEMENT AND TENNIS COURT COATING MACHINE

FIELD OF THE INVENTION

The present invention relates to devices for applying protective coating to pavement, such as driveways and parking lots and court surfaces.

BACKGROUND OF THE INVENTION

A very large industry has existed for many years in the U.S. called "The Asphalt Sealing Industry". Its primary function is to apply a protective "coal tar" sealer to new and old asphalt to retard oxidation, and protect asphalt from the damaging fluids from automobiles. "Oxidation" causes severe deterioration in asphalt if the asphalt is left uncoated. In the northern parts of the U.S., ice and snow melts causing major problems to all asphalt. The salt that is added to melt the ice, accelerates the deterioration of the asphalt. The end result is a disaster for roads, parking lots, driveways, and any other asphalt base exposed to the elements. Another major problem for asphalt is caused by automotive fluids leaking from automobiles, such as brake fluid, oil, fuel, etc. These fluids and the oxidation process cause the asphalt to "ravel" and pot holes soon appear.

Sealcoat contractors, contract with the owners of large parking areas to apply the "coal tar sealer" to the asphalt to protect it. The coal tar is effective but there are numerous problems associated with its use. It has a very strong odor that lasts for several days. The application by spray equipment allows the particles to become airborne getting on workers, vehicles, buildings and any object unprotected. Coal tar also has a severe "tracking" problem. It requires a long time to cure due to the spray process piling material up. It is preferred to have a constant milthickness regardless of the unevenness of the base (within ½ inch or less). This does not of course include holes or drop offs that would exceed the brush limits. The tracking is a problem to restaurant or fast food franchises because it brings the smell and the material inside. A significant "do-it-yourself" program has not evolved, due to the skill required in applying the sand filled material as well as the difficulty in handling the product. The inexpensive coal tar sealer sold at stores is pure and has no sand. This means that it will last less than six or eight months. Sand filled coatings last in excess of two years and is by far the preferred material.

My invention is designed to apply sand filled coatings as well as pure materials. Due to the simplicity of operation, and the cleanliness of the procedure, the small businessman can apply the material for half the cost of contractor applications and create a beautiful, protected parking area, that will last for years. It also eliminates the problems caused by the spray application of the material.

Reference should be made to Pat. Nos. 4,789,265 to Wilson et al., 4,906,126 to Wilson et al. and 4,917,533 to Wilson et al. as they relate to resurfacing machines which employ brushes and squeegees or blades to spread and apply coating material. In U.S. Pat. No. 4,917,533, the use of end brushes is discussed with reference to FIGS. 15*a*, 15*b* and 15*c*. However, end brushes do not provide the seal construction as herein described in the detailed description so as to substantially prevent the flow of sealant outside the ends of the machine.

Additional objects and advantages of the invention will become apparent upon reading the detailed description of the invention in conjunction with the accompanying drawings.

DETAILED DESCRIPTION OF THE DRAWINGS

FIG. 2 is a side view with the end blades removed;

FIG. 3 is a front view of the end blades attached to the frame;

FIG. 4 is a side view of an end blade;

FIG. 5 is an end view of a single end blade;

FIG. 6 is a perspective view of an alternative embodiment for a pavement and tennis court coating machine;

FIG. 7 is a view of the bottom of the box seal construction; and

DETAILED DESCRIPTION OF THE INVENTION

Figure 1:
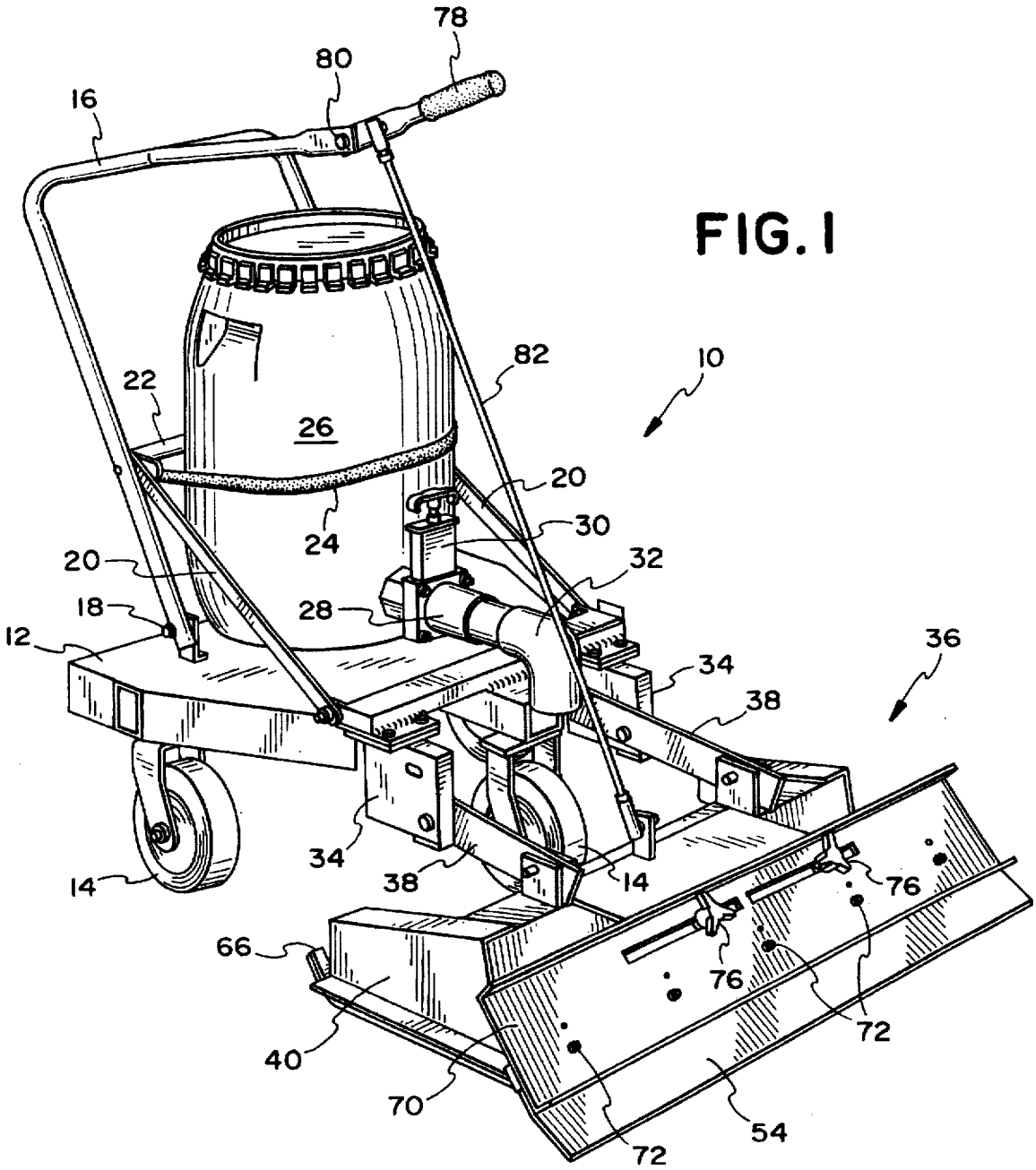
FIG. 1 is a perspective view of the first embodiment of the pavement and tennis court coating machine.

FIG. 1 shows a pavement and tennis court coating machine 10 having a base 12 supported by three wheels or casters 14. On the base is supported a towing frame 16 connected to the base 12 by bolts or other fasteners 18 and support braces 20 and a cross bar 22 adds further stability to the frame 16. A support strap 24 is connected at each end and retains a coating material container 26 adjacent cross bar 22. Container 26 includes a discharge tube 28 extending from a lower portion of the container 26. Discharge tube 28 includes a valve 30 located thereon to regulate flow of material through the discharge tube 28. An elbow 32 is joined to discharge tube 28 to direct the flow of coating material downward to the surface to be coated. It is to be understood that other nozzle or fluid dispersion devices may be attached which in combination with the valve 30 can control the gravity flow of coating material so that the material is applied in a constant flow as desired at walking speed.

A pair of brackets 34 extend downwardly from the base 12 which facilitate connection of the coating material spreading applicator 36. A pair of support arms 38 extend from the brackets 34 to support the coating material spreading applicator 36.

The applicator 36 will now be described with respect to FIG. 2. As shown in FIG. 2, when the coating machine 10 is operated in the direction of the arrow as shown in FIG. 2, a pair of end blades 40 and a first blade or squeegee 42 depend from the squeegee support frame 44. Squeegee 42 first contacts the freshly applied coating material and forces the coating underneath and the thickness of the coating is determined by the setting on the slotted squeegee holder 46 on the frame 44. Preferably, the squeegee 42 is 4 inches in width and preferably constructed of 60 durometer rubber. A brush 48 follows the first squeegee and is preferably angled to allow it to remove any excess coating material from surface undulations without removing the desired thickness. The brush 48 is preferably a 4 inch polyprophylene brush. A second squeegee 50 follows the brush 48 and is mounted on a weighted holder 52 that provides the necessary down pressure and keeps the brush from lifting end blades 40. The second squeegee 50 is of 50 durometer rubber and is mounted on a weighted holder that is 4 inches wide and a ½ inch thick and weighs 0.56 lbs. per linear inch. The weighted blade is preferably precisely balanced so that it holds down the end blades and does not create a "rocking" problem of lifting the front. A final trim squeegee 54 applies the finish to the surface. It is preferably very soft and designed to eliminate any marks left by the blades or the brush and is placed at an angle that will not remove material. Preferably, the final trim squeegee lays flat two inches on the coated surface to provide a wiping action. Preferably, the final trim squeegee 54 is formed of 35 durometer gum rubber. The first and second squeegees 42, 50 and the brush are 24 to 30 inches in length, although the length could be altered up to 20 feet or so if desired depending on the particular application. Preferably, the final trim squeegee 54 is about 6 inches larger than the first and second squeegees 42, 50, because it is desired to have about a 3 inch overlap on each side to remove the traces of the end blades 40 in the applied coating material.

Now turning to FIG. 3, a front view of the applicator with the brush and second squeegee and trim squeegee 48, 50, 54 all removed to reveal the adjustable slots 56 for raising and lowering the first squeegee 42. In FIG. 3, the end blades 40 are also shown cross section to illustrate a support strip extending along the exterior side 58 which is preferably formed of ½" metal and the rubber runner insert 60 which is partially inserted into slot 62 as also shown in FIG. 5. Rubber insert 60 is preferably ¼"×½"×+e,fra 15+ee " and runs the length of the end blade 40 as shown in FIG. 4. Inserts 60 are held in place as shown in FIG. 4 by a pair of screws or bolts 64 which engage the ends of rubber insert 60 at upturned flanges 64. End blades 40 are supported on support frame 44 preferably at a slight angle to the vertical by screws or bolts 68 through angled flange 69. The slight angle at the end blade flange 69 draws the bottom against blades 42 and 50 when the bolts 68 are tightened on applicator frame 44.

Referring now back to FIG. 1, trim squeegee 54 is held to a second squeegee support frame 70 by fasteners 72 although it should be understood that adhesive could also be used. Preferably, a pair of threaded fasteners 76 extend through the adjustment slots and engage with support frame 44. The trim squeegee 54 is held at approximately a 45° angle to decrease down pressure on the approximate 2 inches of blade contacting the applied material.

Still in reference to FIG. 1, the coating machine 10 includes a lifting rod handle 78 extending from towing frame 16 and having a pivot point 80 and attached to the lifting rod handle 78 is a lifting tie rod 82 which extends down and connects at its other end 82 to the coating material spreading applicator 36. The lifting rod handle 78 can be raised in an upper position thereby lifting the coating material spreading applicator 36 off the surface.

FIG. 6 shows an alternative embodiment pavement and tennis court coating machine 100. Machine 100 includes a central frame 102 extending between a pair of end blades 104, 106. Frame 102 supports a first blade 108 for leveling off the coating material and a brush 110 is supported between the end blades 104, 106 for spreading the sealant material. A second blade 111 is supported between end blades 104, 106 and between brush and trim blade 112. Trim blade 112 is connected to the frame 102 by flange 114 via support bracket 116. A pair of casters 118, 120 are joined to end blades 104 and 106 respectively and include vertical adjustment threads 122 for varying the height of the machine. A pulling handle 124 is connected to frame 102 by bolts or other suitable connection devices 126. Preferably, end blades 104, 106 are of similar construction to those shown with respect to the preferred embodiment of FIGS. 1–5.

FIG. 7 shows the applicator 36 in an upside down configuration to reveal a box seal construction 130 defined by surfaces 132, 134, 136 and 138. The seal 130 is formed by portions 132 and 136 of end blades 40 and by first squeegee 42 and second squeegee 50. Brush 48 extends centrally within seal 130 approximately 1 ½ inches so as to be positioned to apply the coating material to the surface as well as to cracks and small depressions. The box seal construction 130 is an important aspect of the invention and facilitates the proper application of the sealant material.

In operation, the coating machine 10 is used in a preferred embodiment of FIGS. 1–5 as follows. The material for sealing the pavement or court surface is applied via the tank and deposited in front of the first blade 42 as the machine 10 is pulled a series of blades and brush apply the material evenly to the surface and the end blades 40 retain the material within box seal construction 130 formed by the end blades 40 and the trim blade or trim squeegee 54. It should be understood that the end blades and trim blade are closely engaged to maintain the coating material within the open ended box formed by the end blades and trim blade.

Figure 8:
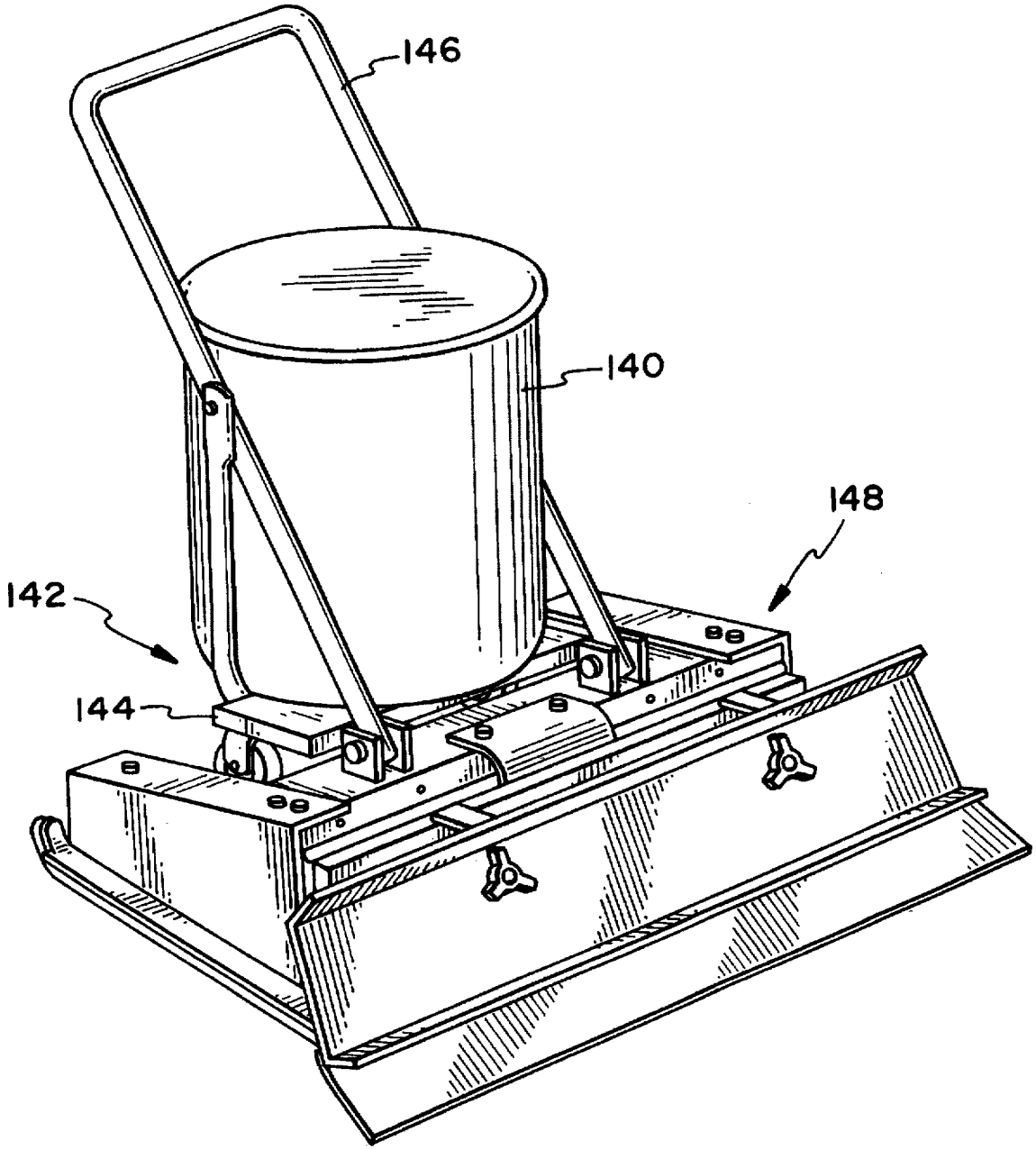
FIG. 8 is a perspective view of another embodiment of the pavement and tennis court coating machine.

FIG. 8 shows a modified version of the coating machine 100 wherein the casters have been removed and a container 140 is carried by a dolly 142 having a wheeled base 144 and a towing handle 146 and is connected to an applicator 148 which would be identical to that described with respect to FIGS. 1–7.

While this invention has been described as having a preferred design, it is understood that it is capable of further modifications, uses and/or adaptions of the invention following in general the principle of the invention and including such departures from the present disclosure as come within the known or customary practice in the art to which the invention pertains and as maybe applied to the central features hereinbefore set forth, and fall within the scope of the invention and the limits of the appended claims.

What is claimed is:

1. A coating apparatus comprising:

a) a support frame;

b) a tank for containing coating material mounted on said support frame, said tank having a conduit connected thereto for dispensing coating material onto a surface;

c) a coating material spreading applicator mounted on said support frame for applying coating material, said applicator including a first blade and a finish blade and a pair of end blades; and d) whereby said end blades are mounted to said support frame independently of said first blade and said finish blade.

2. The coating apparatus as set forth in claim 1, wherein:

a) said frame is supported upon wheels and includes a handle for facilitating manual propulsion of said frame.

3. The coating apparatus as set forth in claim 1, wherein:

a) said end blades are detachably connected to said support frame.

4. The coating apparatus as set forth in claim 1, wherein:

a) said frame is supported upon casters and includes a handle for facilitating manual propulsion of said frame.

5. The coating apparatus as set forth in claim 1, wherein:

a) each of said end blades includes a vertically extending portion located between an upper flange and a lower flange, said upper flange being adapted for connection to said frame and said lower flange adapted for retaining a runner.

6. The coating apparatus as set forth in claim 5, wherein:

a) said runner is formed of a rubber insert.

7. The coating apparatus as set forth in claim 1, wherein:

a) said spreading applicator further includes a brush and a middle blade.

8. The coating apparatus as set forth in claim 1, wherein:

a) said first blade is formed of 60 durometer rubber.

9. The coating apparatus as set forth in claim 7, wherein:

a) said middle blade is formed of 50 durometer rubber.

10. The coating apparatus as set forth in claim 1, wherein:

a) said finish blade is formed of 35 durometer gum rubber.

* * * * *